US006006916A

United States Patent [19]

Matsos et al.

[11] Patent Number: 6,006,916

[45] Date of Patent: Dec. 28, 1999

[54] COSMETIC SAMPLER WITH APPLICATOR BACKING

[75] Inventors: Emmanuel B. Matsos, Baltimore; Catholyn T. Griffiths; Anthony J. Gunderman, both of Phoenix, all of Md.

[73] Assignee: Color Prelude, Inc., Baltimore, Md.

[21] Appl. No.: 09/096,583

[22] Filed: Jun. 12, 1998

[51] Int. Cl.[6] ..... B65D 73/00; A45D 40/00

[52] U.S. Cl. ..... 206/581; 206/229; 206/823; 53/452; 132/320; 283/56

[58] Field of Search ..... 206/581, 823, 206/484, 229; 132/317, 320, 319; 283/56; 53/452, 453, 456

[56] References Cited

U.S. PATENT DOCUMENTS

| | | |
|---|---|---|
| 1,743,512 | 1/1930 | Aisen . |
| 1,744,532 | 1/1930 | Ean . |
| 1,836,833 | 12/1931 | Ames . |
| 1,885,076 | 10/1932 | Bustamante . |
| 2,061,139 | 11/1936 | Cohen . |
| 2,088,076 | 7/1937 | Winslow . |

(List continued on next page.)

FOREIGN PATENT DOCUMENTS

| | | |
|---|---|---|
| 0197184 | 7/1985 | European Pat. Off. . |
| 0197206 | 12/1985 | European Pat. Off. . |
| 0263327 | 9/1987 | European Pat. Off. . |
| 0252001 | 1/1988 | European Pat. Off. . |
| 2589271 | 10/1986 | France . |
| 2601865 | 1/1988 | France . |
| 13537 | 8/1938 | Japan . |
| 53-116906 | 10/1978 | Japan . |
| 56-112973 | 1/1980 | Japan . |
| 56-165661 | 5/1980 | Japan . |
| 57-103862 | 12/1980 | Japan . |
| 57-184967 | 5/1981 | Japan . |
| 56-108703 | 8/1981 | Japan . |
| 57-37560 | 3/1982 | Japan . |
| 58-162677 | 9/1983 | Japan . |
| 58-163420 | 9/1983 | Japan . |
| 59-22473 | 2/1984 | Japan . |
| 59-82414 | 6/1984 | Japan . |
| 60-67408 | 4/1985 | Japan . |
| 60-129206 | 8/1985 | Japan . |
| 60-178356 | 9/1985 | Japan . |
| 60-149314 | 10/1985 | Japan . |
| 61-56602 | 3/1986 | Japan . |
| 1329309 | 9/1973 | United Kingdom . |
| WO8807825 | 10/1988 | WIPO . |

OTHER PUBLICATIONS

"Practical Technique for Screen Printing".

"Photomechanical Process Silk Screening".

"New Screen Printing Technology Complete Collection", vol. 4, Some Applied Theories of Screen Printing, Seri Graph Co. (Feb. 25, 1986).

Kirk–Othmer, Encyclopedia of Chemical Technology, vol. 6, 2nd Ed., Sep. 1965, pp. 363–366.

E. Noteboom, "Screen Printing: Where Did It All Begin?", Screenprinting (1992), pp. 52–56, 103, 122.

A Series of Well–Known and Widely Used Technqiues (Cosmetic Items and Containers), Japanese Patent Office Gazette.

*Primary Examiner*—Paul T. Sewell
*Assistant Examiner*—Luan K. Bui
*Attorney, Agent, or Firm*—Ostrolenk, Faber, Gerb & Soffen, LLP

[57] ABSTRACT

A cosmetic sampler package comprising a slurry of cosmetic and solvent which is printed onto a transparent or translucent film overlay. The film overlay includes opaque portions printed in the negative image of the desired design on the surface opposite that of the cosmetic, so as to form a display window for viewing the cosmetic sample. A perimeter adhesive may be printed on the film overlay around the sample and a protective backing is sealed to the film. The entire surface of the protective backing which faces the cosmetic sample is covered with a texturized layer of flocked fabric fibers so that the backing may be used as an applicator for the cosmetic sample.

36 Claims, 2 Drawing Sheets

U.S. PATENT DOCUMENTS 2,133,914 10/1938 Burke .
2,175,133 10/1939 Singleton .
2,185,386 1/1940 Valentine .
2,214,510 9/1940 Robinson .
2,234,657 3/1941 Smaldone .
2,378,935 6/1945 Kraft .
2,561,400 7/1951 Morrell .
2,735,435 2/1956 Feinstein .
2,775,249 12/1956 Morrell .
2,998,812 9/1961 Hurdel .
3,157,912 11/1964 Lisczawka .
3,568,684 3/1971 Reece .
3,779,848 12/1973 Maierson .
3,788,917 1/1974 Linda .
3,811,987 5/1974 Wilkinson et al. .
3,860,016 1/1975 Mackiernan .
3,888,689 6/1975 Maekawa et al. .
4,224,092 9/1980 Thompson .
4,372,098 2/1983 Mason .
4,487,801 12/1984 Turnbull et al. .
4,493,869 1/1985 Sweeny et al. .
4,611,611 9/1986 Beal, Jr. .
4,661,388 4/1987 Charbonneau .
4,725,495 2/1988 Garbe et al. .
4,735,827 4/1988 Frank et al. .
4,747,782 5/1988 Campbell, Jr. .
4,751,934 6/1988 Moir et al. .
4,752,496 6/1988 Fellows et al. .
4,755,433 7/1988 Patel et al. .
4,774,133 9/1988 Doree et al. .
4,805,773 2/1989 Sabongi .
4,824,143 4/1989 Grainger .
4,848,378 7/1989 Moir et al. .
4,876,136 10/1989 Chang et al. .
4,884,680 12/1989 Israel et al. .
4,884,719 12/1989 Levine et al. .
4,889,755 12/1989 Charbonneau .
4,890,872 1/1990 Parrotta et al. .
4,925,667 5/1990 Fellows et al. .
4,940,584 7/1990 Tararuj et al. .
4,952,400 8/1990 Tararuj et al. .
4,988,557 1/1991 Charbonneau .
4,995,408 2/1991 Wallschlaeger .
4,996,044 2/1991 Mercado et al. .
5,000,202 3/1991 Stepan .
5,031,647 7/1991 Seidler .
5,037,139 8/1991 Schoenleber et al. .
5,072,831 12/1991 Parrotta et al. .
5,105,941 4/1992 Dolan et al. .
5,160,022 11/1992 Mennella .
5,161,688 11/1992 Muchin .
5,301,697 4/1994 Gueret .
5,348,031 9/1994 Cloud .
5,391,420 2/1995 Bootman et al. .
5,439,172 8/1995 Comyn et al. .
5,518,790 5/1996 Huber et al. .
5,533,622 7/1996 Stockley, III et al. .
5,535,885 7/1996 Daniel et al. .
5,562,112 10/1996 Gunderman .
5,566,693 10/1996 Gunderman .
5,568,866 10/1996 Grosskopf et al. .
5,622,263 4/1997 Greenland .
5,645,161 7/1997 Whitaker et al. .
5,647,941 7/1997 Gunderman .
5,690,130 11/1997 Gunderman .
5,718,098 2/1998 Grosskopf et al. .
5,799,675 9/1998 Gunderman .

COSMETIC SAMPLER WITH APPLICATOR BACKING

BACKGROUND OF THE INVENTION

1. Field of the Invention

The present invention relates to a cosmetic sampler and, more specifically, to a disposable unit dose or single application package for providing a cosmetic sample.

2. Description of the Related Art

Cosmetics have typically been available for sampling in department stores in the very containers in which the product is sold, or in smaller versions of the same container. This method generally works well with fragrances, where the product is applied by spraying onto the skin of the consumer such that the product reservoir remains untouched. Such method is less effective in marketing cosmetics, however, because many consumers feel uneasy about sampling a product from a container from which others have previously sampled due to the fear of contracting disease or infection.

The prior art has attempted to provide a more inexpensive and convenient means of marketing cosmetics by hand-outs or by mail, e.g., as inserts in department store bills or magazines. One such sampling means is a cosmetic "strip", which consists merely of make-up samples deposited on a substrate covered by a paper mask, as disclosed in U.S. Pat. No. 4,752,496 to Fellows et al. Such "strips" do not allow for the presentation of the cosmetic sample in a design pattern, however, nor do they allow for the simultaneous presentation of a number of colors in a single design.

In another example, U.S. Pat. No. 4,884,719 to Levine et al. describes a cosmetic sampler wherein the product is deposited on a substrate and is covered with a transparent cover sheet. While this invention allows the consumer to fully view the color of the product without any initial manipulation of the package, the sample is subject to offset or smearing between the two layers, thus ruining any design pattern of the product sample.

An attempt has been made to address the problem of offset in U.S. Pat. No. 4,824,143 to Grainger. In this sampler package, a transparent bubble insert is disposed in a window over the product sample. The package is formed with multiple panels and window cutouts surrounding the bubble through which the sample is viewed. This invention, however, is complicated in design and is cumbersome to use for the consumer. Furthermore, the sampler would not be suitable for distribution in mail inserts or magazines due to its relatively bulky dimensions.

If the product to be sampled requires an applicator, such as a cosmetic powder or blush, the consumer often has to resort to using her fingers to apply the sample, as with the sampler disclosed in U.S. Pat. No. 5,072,831 to Parrotta et al. The drawback, of course, is that the application process is messy; moreover, it is difficult to achieve an even coverage of the product using one's fingers.

The problems described above arise in the distribution of samples of creams, lipsticks, fragrances, pharmaceuticals, lotions, and other types of high viscosity, waxy materials.

SUMMARY OF THE INVENTION

The present invention overcomes the drawbacks of the prior art discussed above by providing a cosmetic sampler package comprising a slurry of cosmetic and solvent which is printed onto a transparent or translucent film overlay. The film overlay includes opaque portions printed in the negative image of the desired pattern or design on the surface opposite that of the cosmetic, so as to form a display window for the sample. A protective backing is then sealed to the film, covering the sample. The protective backing is additionally provided with an applicator material on the surface of the protective backing facing the sample to serve as a built-in applicator.

Individual samplers of the present invention contain enough product for one "unit dose" application of the cosmetic, and can be used to sample creams, lipsticks, fragrances, pharmaceuticals, lotions, and other high viscosity, waxy materials.

Other features and advantages of the present invention will become apparent from the following description of the invention which refers to the accompanying drawings.

DETAILED DESCRIPTION OF THE PREFERRED EMBODIMENT

Figure 1:
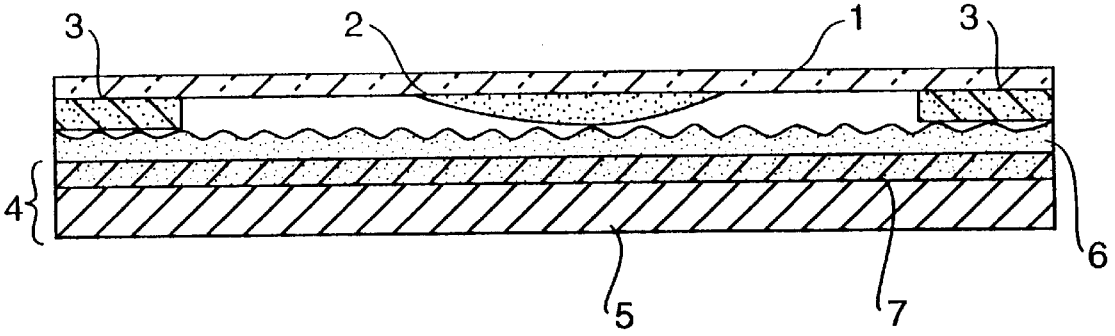
FIG. 1 shows a side cut-away view of an embodiment of the present invention.
Figure 3:
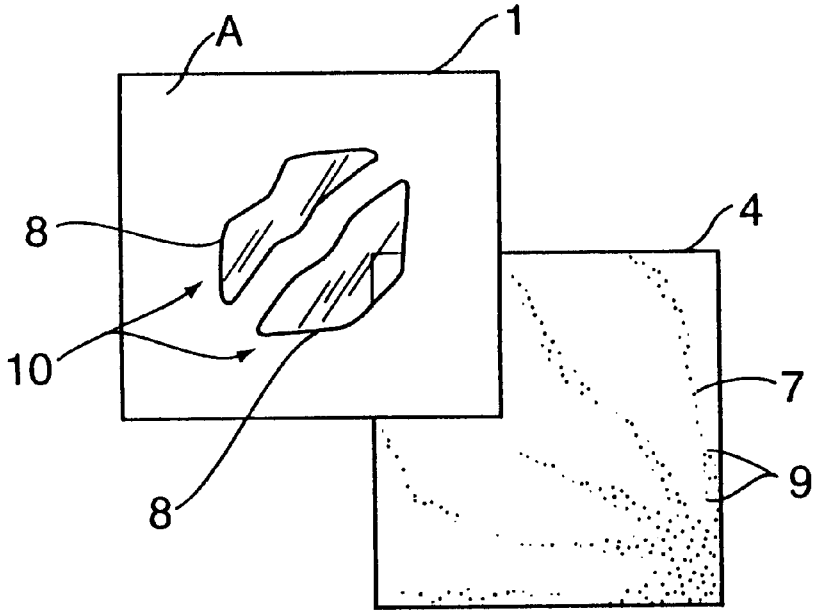
FIG. 3 shows a top-side view of another embodiment of the present invention.

FIG. 1 depicts an exemplary embodiment of the present invention which comprises a transparent or translucent cover film 1, onto which a sample of cosmetic product 2 is printed on the bottom surface B in any desired pattern or design 10, as shown in FIG. 3. A protective backing 4 is sealed or laminated to film 1 around the cosmetic 2, covering the same to protect the sample until ready for use by the consumer. Protective backing 4 is also designed to function as the applicator for the cosmetic sample and includes an applicator material 6 covering the surface of backing substrate 5. Protective backing 4 is sealed to the film 1 with the applicator material 6 facing the cosmetic sample 2.

Film 1 may be any type of flexible plastic sheet or thermoformable film having a thickness of 0.5–12.0 mils, such as amorphous polyester, co-polyester, PVC, PET, polycarbonate, high density polyethylene, polypropylene, high impact polystyrene, or derivatives thereof, but is preferably formed of a treated polyester resin film such as "MYLAR"™. The top surface A of cover film 1 may be printed with at least one window 8, through which the color of sample 2 may be viewed. Window(s) 8 may be of any shape, pattern, or design 10, such as a pair of windows in the shape of a pair of lips, as shown in FIG. 3. In the example shown in FIG. 3, cover film 1 is printed with the negative image of a pair of lips, so that lip-shaped windows 8 remain transparent while the rest of cover film 1 is blocked with print. In this manner, several shades or colors of the product may be displayed in one sampler with each color occupying one window. Additionally, cover film 1 may contain copy print on both the opaque and transparent sections, such as for labeling the product or providing directions for application. Alternatively, cover film 1 may be translucent with no windows and with copy print on the top surface A.

Figure 4:
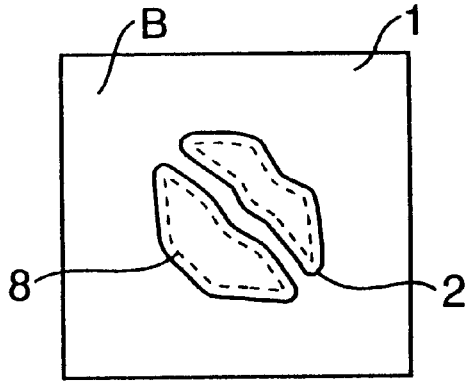
FIG. 4 shows the bottom view of the film 4 shown in FIG. 3.

Product sample 2 is printed onto the bottom surface B of the film at a location opposite each window 8 in an area at least slightly larger than the corresponding window, as shown in FIG. 4. This arrangement allows for a sharp presentation of the colors and designs, since the edges of each design or pattern section are hidden behind the window borders. Thus, any irregularities in the edges of printed cosmetic 2 or any offset of the cosmetic is not seen from the topside A of cover film 1. Preferably, the cosmetic is screen printed onto film 1, although other known printing methods such as flexography or lithography may be used. In a further embodiment, film 1 may be embossed to form a well in the shape of the desired pattern, and the cosmetic product is deposited therein.

In the preferred process for making the invention where the cosmetic sample to be distributed is a powder-based product such as a pressed compact, eye shadow or blush, cover film 1 is run through a screen printing press and printed with as many colors of make-up 2 as desired and allowed by the press configuration. These deposits of make-up may be in virtually any shape and size compatible with the press and may be in proximity and registered with each other. In one example process, a moderately coarse mesh (125 threads per inch) from Majestech and a sharp 80–85 durometer squeegee are used to deposit the make-up onto the film. The mesh has an unusually fine thread for its count resulting in a smooth screen with a high percentage of open area.

The make-up slurry is formed by wetting the make-up with a solvent compatible with the chemistry of the powder. For instance, a pearlescent eye shadow with inorganic pigments that wet well can be used with an evaporating solvent such as ethyl alcohol or isopropyl alcohol. If a coarse screen and a poorly lubricated powder are used together, additional wetting agents or lubricants such as glycerine or silicone oil may be added to the slurry. The viscosity of the slurry and the amount of solvent added must be tailored to the individual powder, as is the choice and amount of lubricant or wetting agent, although the amount of lubricant should preferably be kept below 5%. Following screen printing of the slurry, the solvent evaporates to leave a sample of make-up 2 on film 1.

Figure 2:
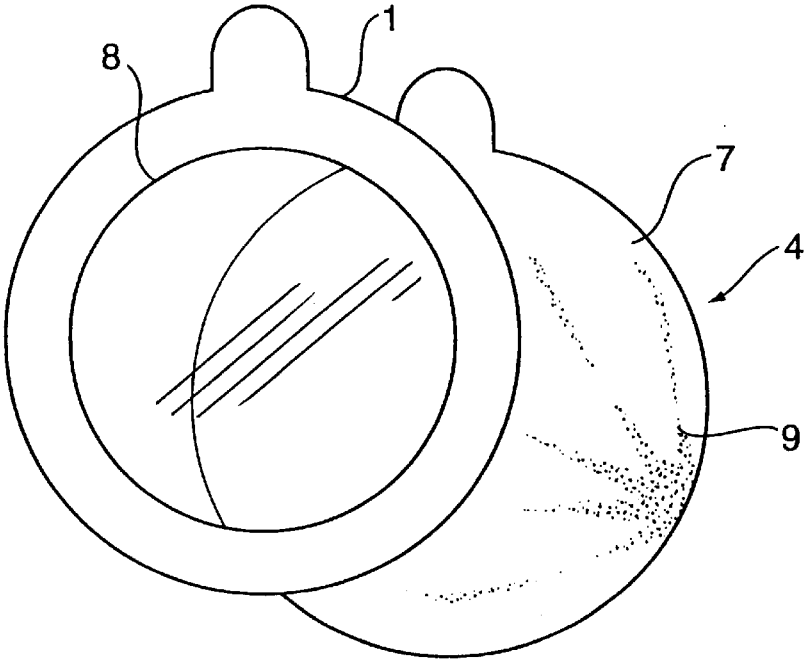
FIG. 2 shows an exploded top view of an embodiment of the present invention.

Substrate 5 of protective backing 4 may be comprised of board, paper, or plastic, and may be coated with a polymer film such as polypropylene, polyethylene, Mylar™, high impact polystyrene, or derivatives thereof. The protective backing 4 additionally includes an applicator material 6 covering the surface of substrate 5 which faces cosmetic sample 2. Applicator material 6 may be applied in an embossed/debossed pattern 9, as shown in FIG. 2, onto backing substrate 5. It has been discovered that by applying the applicator material in a pattern, adherence of the applicator material to the backing substrate is improved so that the applicator material does not pull away from the substrate upon separation of the backing and the film during use. Furthermore, the patterned applicator provides for more even coverage of the cosmetic sample upon application.

In one embodiment, an adhesive 3 is printed on the backing substrate. Fibers such as cotton, nylon, acrylic, or combinations thereof, are introduced into a chamber and, by electrostatic assist, the fibers are flocked on the substrate. Using flocking, the fabric fibers can be applied in a chosen register or pattern to form the applicator. The applicator may then be die cut to the desired shape while still attached to the unit. Optionally, the applicator backing may additionally be embossed in the die cut shape. In other embodiments, the applicator material may comprise a woven fiber or a reticulated or nonreticulated foam, and may be attached to the backing substrate by lamination.

Next, perimeter adhesive 3 is printed on cover film 1, and applicator backing 4 is then laminated to the printed film 1, with the applicator side 6 facing cosmetic sample 2. Adhesive 3 is preferably, but not necessarily, pressure sensitive. Other forms of adhesives which are consistent with the present invention include anaerobic, self crosslinking, U.V. curable, or heat curable adhesives, or the adhesive material can simply be dried by evaporation. Alternatively, applicator backing 4 may be sealed to cover film 1 using other methods such as hermetic sealing with heat or fusion or sonic sealing, and may be accomplished either with or without the addition of an adhesive as detailed above.

The use of screen printing techniques according to the preferred embodiment of the present invention for preparing make-up samples is not limited to samples of eyeshadows or other inorganically pigmented powders. Organically pigmented powders may also be sampled by adjusting the solvent system and by, if necessary, reducing the pigment loading to compensate for the tendency of some organic pigments to develop in a liquid medium. Such a technique would also allow the sampling of blush, for example. The present invention is additionally applicable to sampling non-liquid but oily products, such as lipstick, sunscreen stick, stick deodorant, or any oily, non-liquid pharmaceutical product.

Where the cosmetic sample is a wax-based product such as lipstick, an effective method of screen printing the sample onto cover film 1 is described below. Although this process is directed to the screen printing of lipstick, the method is similarly applicable to any type of wax-based product.

First, the lipstick bulk is heated above its melting point of approximately 195° to 205° F. to ensure that the highest melting point waxes are dispersed, and that the lipstick is uniform. The formulation is then augmented by the addition of molten waxes and other additives which are mixed until uniform and poured while still in a molten state into a stainless steel jacketed kettle or a suitably sized plastic container. The mixture is then allowed to cool to return to a solid state. The purpose of introducing additional waxes to the formula is to prevent the lipstick from melting or bleeding oil when exposed to subsequent environmental conditions.

After cooling, the mixture forms a hard waxy product which is not printable. Thus, the next step is to change the material to a paste-like consistency using a conventionally recognized method of grinding or shearing, such as by a rollermill or planetary mixer.

The paste-like processed bulk is added to the screen press at room temperature and printed in a pattern onto the bottom surface of a cover film 1 as described above.

Since the material in the form of a printed paste is not yet a lipstick, the material is then heated to approximately 195° to 200° F. to re-melt, then chilled to form a lipstick. The resulting physical appearance of the lipstick print is shiny, glossy, and liquefied.

Optionally, to ensure that the lipstick will maintain its integrity when exposed to environmental conditions of heat or pressure, a protective overcoat (not shown) may be applied over the printed lipstick. As disclosed in U.S. Pat. No. 5,562,112, this overcoat is printed in the exact pattern as the printed lipstick and serves not only to maintain the integrity of the lipstick, but also to prevent product transfer to applicator backing 4. The overcoat can be selected from a series of polymers which are printed from a solvent system, allowing rapid drying and forming of a uniform film over the lipstick surface. The overcoat material is dried to a uniform film by use of air knives or moving room temperature air. Polymer systems, based upon cellulosics, polyvinyl pyrollidone, pyrollidone ester blends, acrylics, nitrocellulose, have been shown to have certain degrees of effectiveness; however, the material of choice for the overcoat is "NO'TOX"™ from Colorcon Incorporated, Philadelphia, Pa.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A unit-dose cosmetic sampler comprising:

a cover film;

a unit dose of cosmetic preparation printed in a pattern on said cover film, said cosmetic preparation containing a cosmetic product; and a protective backing sealed to said cover film, wherein the protective backing comprises an applicator material provided on a surface of a backing substrate, the protective backing being sealed to the film with the applicator material facing the cosmetic preparation.

2. The cosmetic sampler recited in claim 1, wherein the applicator material comprises a material selected from the group consisting of reticulated foam, non-reticulated foam, cotton, nylon, acrylic, and combinations thereof.

3. The cosmetic sampler recited in claim 1, wherein the applicator material is applied in a continuous layer across the entire surface of the backing substrate facing the cosmetic preparation.

4. The cosmetic sampler recited in claim 1, wherein the backing substrate comprises a material selected from the group consisting of board, paper, and plastic.

5. The cosmetic sampler recited in claim 4, wherein the backing substrate is coated with a polymer film selected from the group consisting of polyester, co-polyester, polypropylene, polyethylene, high impact polystyrene, PET, PVC, and derivatives thereof.

6. The cosmetic sampler recited in claim 4, wherein the applicator material is applied in an embossed and/or debossed pattern onto the backing substrate.

7. The cosmetic sampler recited in claim 1, further comprising a protective polymeric overcoat printed over the printed cosmetic preparation.

8. The cosmetic sampler recited in claim 1, wherein the cover film is transparent.

9. The cosmetic sampler recited in claim 8, wherein the cover film is pre-printed with opaque copy to define at least one transparent window corresponding to the pattern of the printed cosmetic preparation such that the printed cosmetic preparation can be viewed through said at least one transparent window.

10. The cosmetic sampler recited in claim 9, wherein the cosmetic preparation comprises at least one product color.

11. The cosmetic sampler recited in claim 9, wherein the cosmetic preparation comprises multiple product colors.

12. The cosmetic sampler recited in claim 11, wherein the printed pattern comprises more than one distinct section, wherein each of said multiple product colors of said cosmetic preparation is printed to form at least one section of the pattern; and said at least one window comprises a separate window for each section of the pattern, each separate window corresponding in shape to a shape of a different section of the printed pattern.

13. The cosmetic sampler recited in claim 12, wherein said printed pattern sections are in proximity and registered with each other.

14. The cosmetic sampler recited in claim 1, wherein the cover film is translucent.

15. The cosmetic sampler recited in claim 1, wherein the cover film comprises a material selected from the group consisting of a flexible plastic sheet and a thermoformable film, and wherein the thermoformable film is selected from the group consisting of amorphous polyester, co-polyester, polycarbonate, PVC, PET, high density polyethylene, polypropylene, high impact polystyrene, and derivatives thereof.

16. The cosmetic sampler recited in claim 14, wherein the cover film is embossed to form a well in a shape of said pattern and said cosmetic preparation is printed in said well.

17. The cosmetic sampler recited in claim 1 wherein the cover film has a thickness between about 0.5–12.0 mils.

18. A method for making a cosmetic sampler having an applicator backing comprising:

(a) forming a preparation of a cosmetic product;

(b) printing said cosmetic preparation onto a plastic film in a well-defined pattern having at least one distinct section;

(c) providing a protective backing having a backing substrate;

(d) applying an applicator material to a surface of the backing substrate; and (e) sealing said protective backing to said film.

19. The method of making a cosmetic sampler recited in claim 18, wherein the applicator material is applied in a continuous layer across the entire surface of the backing substrate facing the cosmetic preparation.

20. The method of making a cosmetic sampler recited in claim 19, wherein the applicator material is applied in an embossed and/or debossed pattern onto the backing substrate.

21. The method of making a cosmetic sampler recited in claim 19, further comprising the step of die cutting the protective backing to a desired shape after applying the applicator material to the backing substrate.

22. The method of making a cosmetic sampler recited in claim 19, wherein the applicator material is formed from the group consisting of a material selected from a woven fabric, a non-woven fabric, a reticulated foam, and a nonreticulated foam.

23. The method of making a cosmetic sampler recited in claim 22, wherein the step of applying the applicator material to the backing substrate includes printing an adhesive onto the substrate.

24. The method of making a cosmetic sampler recited in claim 23, wherein the step of applying the applicator material to the backing substrate further includes laminating the applicator material to the backing substrate.

25. The method of making a cosmetic sampler recited in claim 22, wherein the woven fabric and the non-woven fabric comprises fabric fibers selected from the group consisting of cotton, nylon, acrylic, and combinations thereof.

26. The method of making a cosmetic sampler recited in claim 25, wherein the step of applying the applicator material to the backing substrate includes printing an adhesive onto the substrate.

27. The method of making a cosmetic sampler recited in claim 26, wherein the step of applying the applicator material to the backing substrate further includes flocking the fabric fibers onto the backing substrate via electrostatic assist.

28. The method of making a cosmetic sampler recited in claim 18, wherein said step of printing said cosmetic preparation is a process selected from the group consisting of screen printing, lithography, and flexography.

29. The method of making a cosmetic sampler recited in claim 28, wherein said printing step is performed using screen printing.

30. The method of making a cosmetic sampler recited in claim 18, wherein the cover film is embossed to form a well in a shape of said pattern and said cosmetic preparation is printed in said well.

31. The method of making a cosmetic sampler recited in claim 18, wherein the cosmetic product is a pigmented powder, and the step of forming the cosmetic preparation comprises forming a slurry of the powder and solvent.

32. The method of making a cosmetic sampler recited in claim 18, wherein the cosmetic product is a wax-based product, and the step of forming the cosmetic preparation comprises processing a paste of the wax-based product which has been augmented with molten waxes.

33. The method of making a cosmetic sampler recited in claim 32, further comprising the step of printing a protective polymeric overcoat over the printed cosmetic preparation.

34. The method of making a cosmetic sampler recited in claim 18, further comprising the step of pre-printing the cover film with opaque copy to define at least one transparent window corresponding to the pattern of the printed cosmetic preparation such that the printers cosmetic preparation can be viewed through said at least one transparent window.

35. The method of making a cosmetic sampler recited in claim 18, further comprising the step of applying a perimeter adhesive to said film prior to sealing said protective backing to said film.

36. The method of making a cosmetic sampler recited in claim 18, wherein said sealing step is performed using a process selected from the group consisting of laminating, hermetic sealing, heat sealing, fusion sealing, and sonic sealing.

* * * * *